United States Patent [19]

Gamadi et al.

[11] Patent Number: 5,044,252

[45] Date of Patent: Sep. 3, 1991

[54] SHRAPNEL ABSORBER

[76] Inventors: Zwi Gamadi, 17 Brenner Street; Yuval Fuchs, 9 Har Zion Street, both of Netanya, Israel

[21] Appl. No.: 363,139

[22] Filed: Jun. 8, 1989

[30] Foreign Application Priority Data

Jun. 16, 1988 [IL] Israel ..... 86763

[51] Int. Cl.[5] ..... F41H 5/06

[52] U.S. Cl. ..... 86/50; 89/36.01; 89/36.07; 109/78; 109/79; 428/119; 428/120; 428/911

[58] Field of Search ..... 706/583; 89/36.07, 36.01; 86/550; 428/911, 120, 119; 109/78, 79

[56] References Cited

U.S. PATENT DOCUMENTS

| | | | |
|---|---|---|---|
| 377,732 | 2/1888 | Adams | 89/36.07 |
| 547,172 | 10/1895 | Maguire | 428/911 |
| 660,716 | 10/1900 | Anderson | 428/911 |
| 1,086,708 | 2/1914 | Hoagland | 86/50 |
| 1,294,191 | 2/1919 | Saderlock | 428/911 |
| 2,387,770 | 10/1945 | Rogers et al. | 89/36.01 |
| 2,969,101 | 1/1961 | White | 86/50 |
| 3,491,847 | 1/1970 | Abbott | 150/154 |
| 3,739,731 | 6/1973 | Tabor | 89/36.01 |
| 3,786,956 | 1/1974 | Tabor | 89/36.01 |
| 3,801,416 | 4/1974 | Gulbierz | 428/911 |
| 3,974,313 | 8/1976 | James | 428/911 |
| 4,200,677 | 4/1980 | Bottini et al. | 428/911 |
| 4,432,285 | 2/1984 | Boyars et al. | 86/50 |
| 4,574,105 | 3/1986 | Donovar | 428/911 |
| 4,664,967 | 5/1987 | Tasdemiioglu | 428/911 |

FOREIGN PATENT DOCUMENTS

| | | |
|---|---|---|
| 0468114 | 6/1914 | France . |
| 2608268 | 6/1988 | France . |

*Primary Examiner*—Ellis P. Robinson
*Assistant Examiner*—Archene A. Turner
*Attorney, Agent, or Firm*—Fleit, Jacobson, Cohn, Price, Holman & Stern

[57] ABSTRACT

A device is provided which affords protection against explosive charges, which is foldable and portable, and which can be used in a planar configuration or folded to provide a protective rim around an inner area. The device is capable of absorbing part of the fragments and shock-waves of an exploding charge.

13 Claims, 3 Drawing Sheets

SHRAPNEL ABSORBER

FIELD OF THE INVENTION

The invention relates to a device for absorbing shrapnels and fragments from explosive devices, such as hand-grenades, booby-traps, terrorist bombs and the like, and for absorbing part of the shock-wave.

The device can be used in a closed configuration (where it is essentially flat), when it constitutes a protective shield for a person approaching a suspicious object, and it can be placed in this position over a small explosive devise, such as a hand-grenade. It can be opened up to provide a four-walled, open-roofed structure, which is placed around a larger explosive device, so as to confine both fragments and the blast wave from such exploding device.

BACKGROUND OF THE INVENTION

During recent years there exists an ever increasing need for devices which can provide protection against explosive devices, such as terrorist bombs, hand-grenades, booby-traps, mines and other such explosive devices.

It is one of the characteristics of terrorist devices, that they are produced in such a manner as to produce a large number of fragments and a large amount of shrapnel, so as to cause maximum casualties uppon explosion. The devices of this kind comprise generally a rather small charge of explosive with a large amount of material providing fragments and shrapnel. There exists also a widespread use of existing devices, such as various types of hand grenades, shells and the like often with added shrapnel. The novel device is intended to provide a high degree of protection from the time of discovery of such devices until it is possible to neutralize such device, safty to remove it or explode it with a minimum of damage to the vicinity.

SUMMARY OF THE INVENTION

The invention relates to a shrapnel absorber (SA) which is provided in the form of a foldable box-like structure, made of a ballistic material adapted to absord shrapnel and fragments of exploding devices.

The material used is a specific type of ballistic polyamide, such as ballistic nylon. Also regular multi-layer nylon fabric of adequate strength may be used. The type used will generally be a type of ballistic nylon, such as that produced by DuPont, which has a weight of from about 300 g to about 500 grams per square meter. Regular nylon cloth having about 20 to 30 layers, with an overall thickness of about 10 to 20 mm can also be used. KEVLAR (T.M.) cloth can be used, with a thickness of about 1 cm.

The device of the invention is demonstrated by way of illustration only with reference to the enclosed schematical drawings not according to size, in which.

Figure 1:
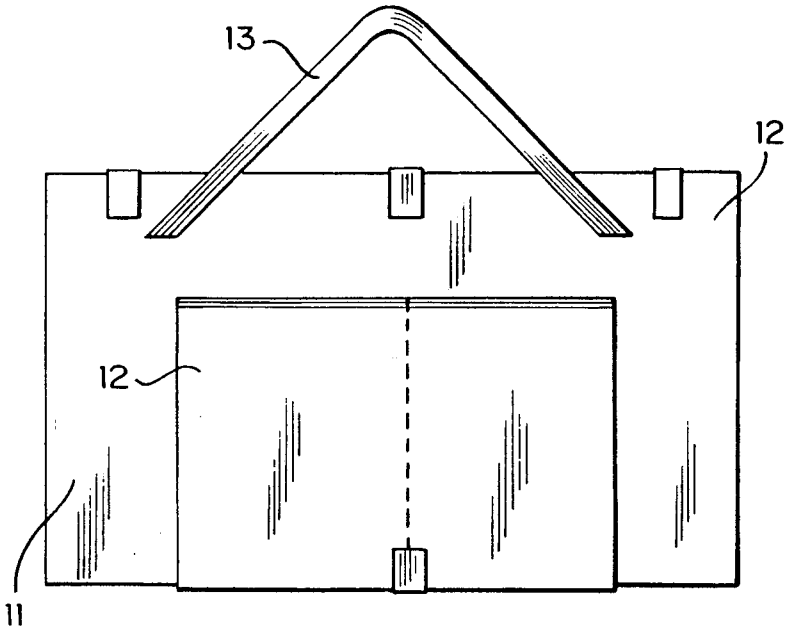
FIG. 1 is a side-view of a device in folded position for carrying.
Figure 2:
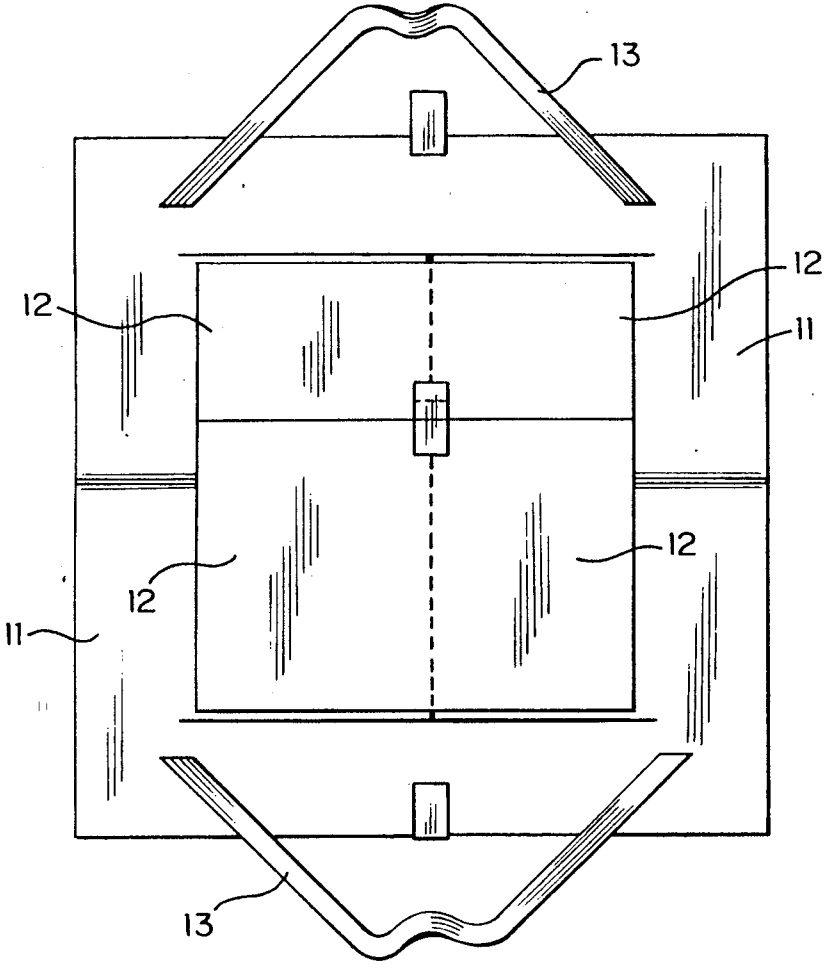
FIG. 2 is a side-view of the same device, in partially open position, for use as a shield and for placing over a small explosive object.
Figure 3:
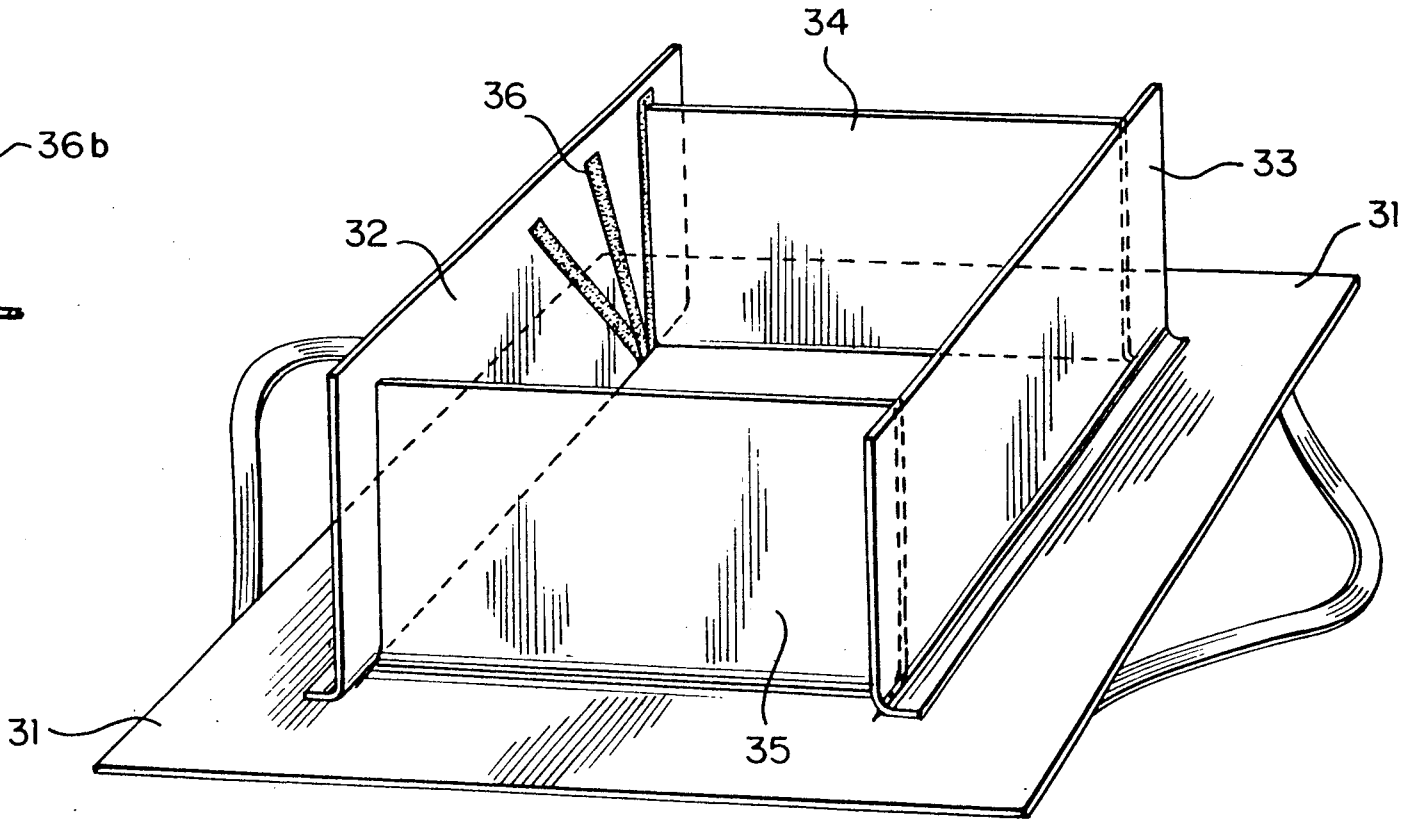
FIG. 3 is a perspective view of an open device for use with larger explosive objects.
Figure 3A:
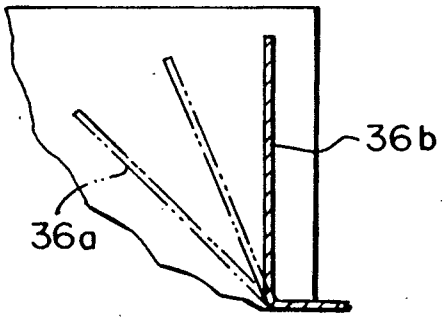

As shown in FIG. 1, the protective device comprises two frame members 11, to which there are attached four flaps 12, which can be opened up to the position shown in FIG. 3, there being provided two carrying strips 13, which can be used when the partially opened up device, shown in FIG. 2, is used as protective shield. The flaps 12 are attached to the inner edge of the frame 11, in a foldable position, and two of these overlap when folded. The device can be opened up to a configuration as shown in FIG. 3. Thus there is obtained a structure comprising a rim 31, which is positioned flat on the ground, and from the inner edges of which there extend the perpendicular flaps 32, 33, 34 and 35. The two flaps 34 and 35 are provided with a Velcro-type attachment means in strip form, 36, which make possible the positioning of these flaps at an angle towards the center, as shown with reference to FIG. 3*a*, and also the main Figure, where various possible positions are indicated as 36*a*, 36*b*. Thus there is formed a confining structure with an open inner space, from which there extend four wall sections extending upwards. When an explosive device is discovered, the open device is placed over such device in such a manner that the explosive charge will be at about the center of the device.

Figure 4:
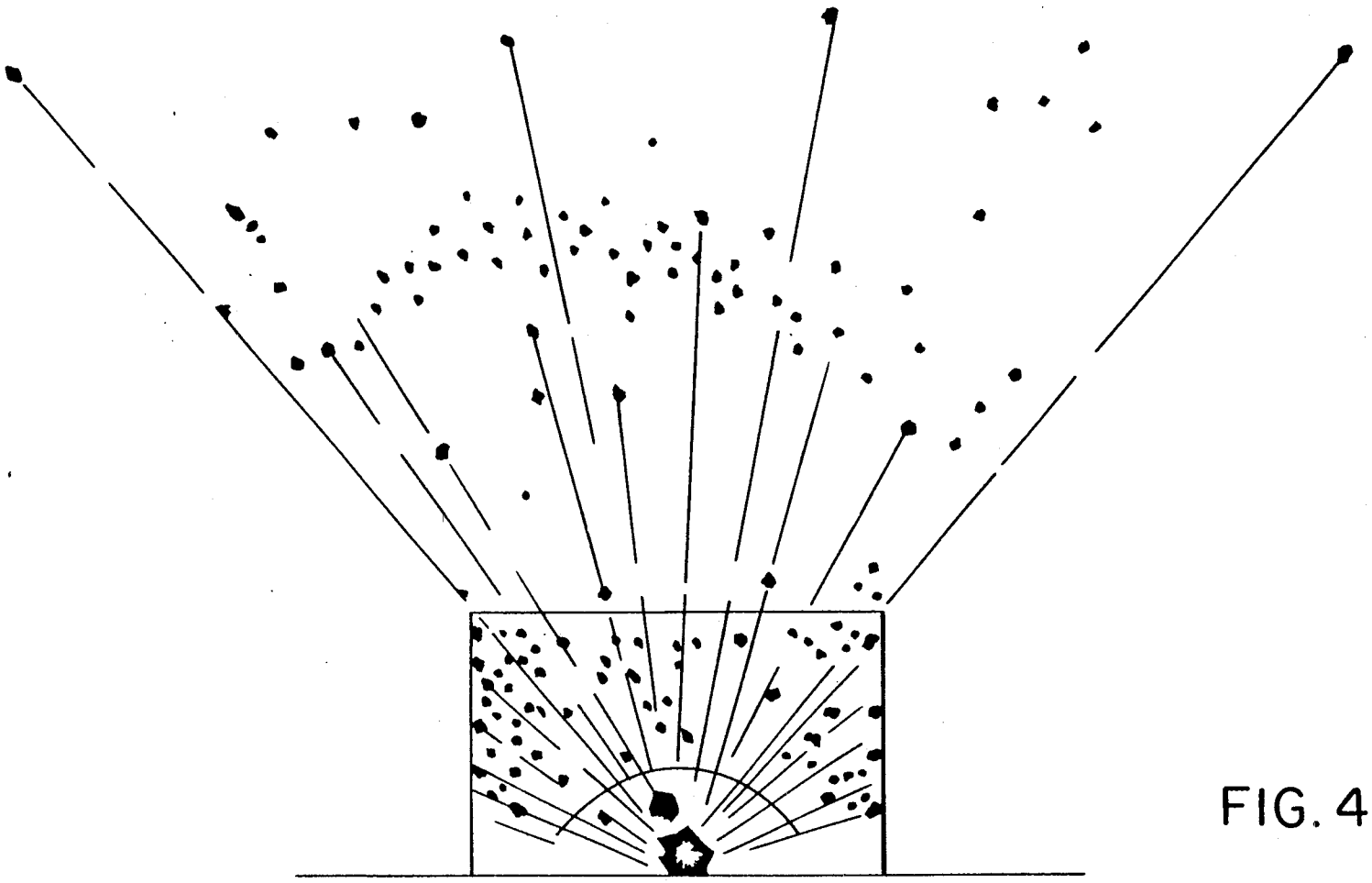
FIG. 4 is a schematical side-view of an open device, which illustrates the confinement of shrapnel and absorption of part of these, affording protection for people and objects within a certain angle of the exploding device.

The protective action of the device is shown in FIG. 4, which illustrates how a fraction of the fragments is confined inside the protective device, and also that part of the shock-wave is absorbed by the device.

When a small bomb is discovered, the disposal expert approaches same with the device held by its handles in a flat form, as shown in FIG. 2, thus providing a good personal protection.

If the charge is a small one, the device is placed on it until it explodes or is exploded. This provides adequate time to evacuate the area liable to be affected, and also to have adequate possibilities of dismantling or of exploding the suspicious object.

The dimensions of the protective device are about 100 cm length of the outer edges, with a total weight of the order of from 10 to 14 kg. With larger objects, the device is opened up to the position of FIG. 3, thus resulting in a confinement of possible fragments and of the shock-wave.

The protective SA can be used by civil defense organizations, by security officers, by army personnel, etc. It can be used by units which deal with the dismantling of old explosive devices, with land mines; it can be effectively used with anti-terror organizations. It is of special use in areas where a plurality of explosive devices are found, and which have to be dealt with one by one.

The above description is by way of illustration only. It is clear that the device can be given different shapes and configurations, and still be in the ambit of the present invention.

We claim:

1. A device adapted to afford protection against explosive charges, bombs and the like, comprising:

a foldable structure, said foldable structure being foldable into a folded form, said foldable structure, when in its folded form, being easily carried;

said foldable structure being partially openable to provide an essentially planar protective shield for placement on top of small explosive devices to absorb both fragments and shock-waves, said foldable structure being fully openable to form a four-sided rim structure having four rim sections defining a rectangular inner area with a foldable flap attached to the inner edge of each rim section, each foldable flap extending in an upward direction the foldable flaps together defining a confinement space, with an open top, adapted to absorb a part of fragments and shock-waves from a large exploding device when said foldable structure is fully opened.

2. A device according to claim 1, wherein said foldable structure is made of ballistic or regular polyamide, of a type adapted to absorb shrapnel.

3. A device according to claim 2, wherein the foldable structure is made of an absorbing material having a thickness of about 10 to 15 mm and a plurality of layers.

4. A device according to claim 1, and further comprising carrying handles provided on said foldable structure.

5. A device according to claim 1, and further comprising means provided on said foldable structure for fixing two opposite flaps at a desired angle with respect to the ground.

6. A device according to claim 1, wherein each rim section is about 100 cm in length and each foldable flap has a height between 30 and 45 cm.

7. A foldable, easily carried protective device comprising:

a rectangular base sheet of explosion and fragment resistant material;

four rectangular sheets defining a smaller rectangle, leaving a border around said smaller rectangle, said four rectangular sheets being hingedly attached to said base sheet, each of said four rectangular sheets being selectively raised into an upright position to form an angle of about 90 degrees with the base sheet, the four rectangular sheets, when in the upright position, together defining a rectangular enclosure.

8. A foldable device according to claim 7, wherein said base sheet comprises two rectangular sections of equal size which are hingedly attached to each other so as to permit folding of the base sheet to a structure of half the area of the base sheet.

9. A foldable device according to claim 8, and further comprising a handle for carrying the base sheet and four rectangular sheets.

10. A device according to claim 7, wherein said rectangular base sheet and four rectangular sheets are made of ballistic or regular shrapnel absorbing polyamide.

11. A device according to claim 7, wherein the base sheet is a multi-layer structure having an overall thickness of from 10 to 15 mm.

12. A device according to claim 8, and further comprising means for holding the four rectangular sheets at a desired angle with the base sheet.

13. A device according to claim 7, wherein the base plate has an area about 100 square cm and each of the hinged sheets has a length of about 50 to 70 cm and a height of between 30 and 45 cm.

* * * * *